US005688109A

United States Patent [19]

Matsuura et al.

[11] Patent Number: 5,688,109

[45] Date of Patent: Nov. 18, 1997

[54] OIL-LEVEL CONTROLLER FOR COMPRESSOR

[75] Inventors: Hideki Matsuura; Hiroshi Kitaura; Keiji Komori, all of Osaka, Japan

[73] Assignee: Daikin Industries, Ltd., Japan

[21] Appl. No.: 591,653

[22] PCT Filed: Jun. 21, 1995

[86] PCT No.: PCT/JP95/01232

§ 371 Date: Feb. 12, 1996

§ 102(e) Date: Feb. 12, 1996

[87] PCT Pub. No.: WO96/00851

PCT Pub. Date: Jan. 11, 1996

[30] Foreign Application Priority Data

Jun. 29, 1994 [JP] Japan ..... 6-147302
Jan. 31, 1995 [JP] Japan ..... 7-013422

[51] Int. Cl.[6] ..... F04B 39/02; F04C 29/02; F01M 11/12

[52] U.S. Cl. ..... 417/228; 418/55.6; 418/88; 418/100; 184/103.1

[58] Field of Search ..... 418/55.6, 88, 100, 418/84; 417/228; 184/103.1, 103.2

[56] References Cited

U.S. PATENT DOCUMENTS 5,000,669 3/1991 Shimizu et al. ..... 418/55.6

FOREIGN PATENT DOCUMENTS

| | | | |
|---|---|---|---|
| 60-30494 | 2/1985 | Japan . | |
| 61-112785 | 5/1986 | Japan . | |
| 61-205386 | 9/1986 | Japan | 418/55.6 |
| 63-158596 | 10/1988 | Japan . | |
| 227189 | 1/1990 | Japan . | |
| 2305392 | 12/1990 | Japan . | |
| 4214983 | 8/1992 | Japan . | |
| 5126066 | 5/1993 | Japan | 418/55.6 |
| 5288170 | 11/1993 | Japan | 418/55.6 |

*Primary Examiner*—John J. Vrablik
*Attorney, Agent, or Firm*—Sixbey, Friedman, Leedom & Ferguson, P.C.; Gerald J. Ferguson, Jr.; Tim L. Brackett, Jr.

[57] ABSTRACT

A lubricant (L) is stored in a lubricant reservoir (2*c*) of a casing (2). One end of a lubricant takeout pipe (15) is in communication with the lubricant reservoir (2*c*) and the other end thereof is in communication with a suction chamber (14) of a scroll mechanism (3). An inlet end of the lubricant takeout pipe (15) opens at the same level as an oil-level high-limit point of the lubricant reservoir (2*c*) in the vicinity of a lower end of a rotor (9*b*). When the level of the lubricant (L) moves up to the high-limit point, an excess lubricant is introduced from the lubricant reservoir (2*c*) into the scroll mechanism (3), since there is produced a difference in pressure between a lower space (2*b*) of the casing (2) and the suction chamber (14). As a result, the level of the lubricant (L) drops.

7 Claims, 6 Drawing Sheets

OIL-LEVEL CONTROLLER FOR COMPRESSOR

TECHNICAL FIELD OF THE INVENTION

This invention relates generally to refrigerating compressors. More particularly, it pertains to an oil-level controller, for use by a refrigerating compressor, for controlling the level of a lubricating oil (hereinafter called a lubricant) stored in the bottom of a compressor casing.

DESCRIPTION OF THE PRIOR ART

Many types of compressors have been proposed. JP Pat. Appln., laid open under Pub. No. 2-305392, discloses one. A compression mechanism is located in an upper space of a casing of the compressor, and located in a lower space thereof is a motor. A crankshaft extends up from the motor for linkage to the compression mechanism. The motor drives the crankshaft, and the crankshaft rotates, and the compression mechanism performs compression operations.

A lubricant is stored in the bottom of the casing, and the lower end of the crankshaft lies in the lubricant. The crankshaft lower end is provided with a pump mechanism, e.g., a centrifugal pump. Additionally, a flow passage is formed through the crankshaft. When the motor drives the crankshaft to rotate, the pump mechanism draws up a lubricant from the casing bottom. This lubricant travels through the flow passage to each of slide sections of the compressor for lubrication.

In the above-noted compressor, a lubricant is stored by a predetermined amount, and the level of the lubricant is, in any case, maintained to fall within a predetermined range, taking into account the fact that the oil level varies between when the compressor is stopped and when the compressor is driven.

In other words, the oil level is high when stopped while it is low when driven. Therefore the oil level is set such that it stays below a rotor of the motor in the stopped state while it stays above the lower end of the crankshaft in the drive state.

However, in spite of the above arrangement, the oil level may not fall in the predetermined range depending upon the operating conditions. If a compressor has not been run for a long period of time, or if a compressor is run in humid conditions, then a liquid refrigerant is likely to be mixed with a lubricant stored in a lubricant reservoir. In other words, in addition to the lubricant the liquid refrigerant is now stored in the lubricant reservoir, which may result in increasing the oil level above a predetermined high-limit point.

As the oil level goes beyond a predetermined point, the area of the crankshaft that is soaked in the lubricant stored in the lubricant reservoir increases. Additionally the motor rotor, too, is soaked in the lubricant. The crankshaft and the motor rotor must rotate against resistance produced by the lubricant. In this case electrical input must be increased so as to maintain the rotation of the crankshaft constant. This, however, produces input loss.

Also, in such a situation, both the crankshaft and the motor rotor stir the lubricant and the temperature of the lubricant increases. This increases the temperature of an entire casing space. As a result the efficiency of compression drops.

JP Pat. Appln., laid open under Pub. No. 4-214983, discloses an oil-level control technique known in the art as a forced differential pressure method. In this forced differential pressure method, two compressors are connected together by an oil-level equalizing pipe and there is produced a difference in pressure between the compressors. Most of the lubricant brought back from a refrigerant circulation circuit is introduced into one of the two compressors that is provided on the high-pressure side, and part of the brought-back lubricant is supplied through the oil-level equalizing pipe to the other compressor provided on the low-pressure side because of the aforesaid pressure difference.

The above-described organization, however, requires two compressors. In other words, it is difficult to accomplish a forced differential pressure technique with a single compressor.

Bearing in mind the above-described problems with the prior art techniques the present invention was made. In accordance with the present invention, the level of a lubricant in a lubricant reservoir can be maintained at a desired point and the increase in the electrical input as well as the increase in the oil temperature can be held as low as possible.

DISCLOSURE OF THE INVENTION

Accordingly the present invention provides an improved oil-level controller capable of self-level control. In other words, when the oil level goes beyond a predetermined point, it is forced to go downward by means of the self-level control function.

The present invention provides a new oil-level controller for use by a compressor, the compressor comprising (i) a casing (2) at the bottom of which is formed a lubricant reservoir (2*c*) for storing a lubricant (L), (ii) a compression mechanism (3) for compressing a compression gas, the compression mechanism (3) being housed in the casing (2), and (iii) a drive mechanism (4) for driving the compression mechanism (3), the drive mechanism (4) being housed in the casing (2) (see FIG. 1). The lubricant (L) is applied from the lubricant reservoir (2*c*) to the compression mechanism (3).

More particularly in accordance with an aspect of the present invention, the compressor oil-level controller is an oil-level lowering means (26) whereby when the level of the lubricant (L) goes beyond a predetermined high-limit point the oil-level lowering means brings the excess level down to the predetermined high-limit point.

In accordance with an aspect of the present invention, the oil level-lowering means (26) comprises a discharge mechanism (27) capable of discharging a lubricant (L) out of the lubricant reservoir (2*c*).

In accordance with an aspect of the invention, the oil-level lowering means (26) comprises a lubricant-recovery prevention mechanism (28) capable of preventing a lubricant (L) from returning to the lubricant reservoir (2*c*) from the compression mechanism (3) in the casing (2).

In accordance with an aspect of the present invention, (i) the discharge mechanism (27) has a lubricant takeout pipe (15) with an inlet end and an outlet end, the inlet end being in communication with the lubricant reservoir (2*c*) and the outlet end being in communication with a suction section (14) of the compression mechanism (3), and (ii) the inlet end of the lubricant takeout pipe (15) opens in such way as to face to the predetermined high-limit point (see FIG. 1).

In accordance to an aspect of the present invention, (i) the casing (2) is connected to a suction pipe (5) for suction of a low-compression gas, (ii) the suction pipe (5) has a low-pressure creation section (5*a*) for creating a pressure lower than that in the lubricant reservoir (2*c*), (iii) the discharge mechanism (27) has a lubricant takeout pipe (15) with an inlet end and an outlet end, the inlet end being in communication with the lubricant reservoir (2*c*) and the outlet end being in communication with the low-pressure creation section (5*a*), and (iv) the inlet end of the lubricant takeout pipe (15) opens in such a way as to face to the predetermined high-limit point (see FIG. 2).

In accordance with an aspect of the present invention, (i) the discharge mechanism (27) has a displacement pump (20) driven by means of the drive mechanism (4) and a lubricant takeout pipe (15) with an inlet end in communication with an outlet end of the displacement pump (20), and (ii) a suction passage (20*d*) formed in the displacement pump (20) has an inlet end that opens in such a way as to face to the predetermined high-limit point (see FIG. 3).

In accordance with an aspect of the present invention, a lubricant-inflow prevention member (29) is disposed in the vicinity of the inlet end of the lubricant takeout pipe (15), the lubricant-inflow prevention member (29) preventing a lubricant (L) present in the casing (2) from flowing into the lubricant takeout pipe (15) (see FIGS. 1 and 2).

In accordance with an aspect of the present invention, a lubricant-inflow prevention member (29) is disposed in the vicinity of the inlet end of the suction passage (20*d*) of the displacement pump (20), the prevention member (29) preventing a lubricant (L) present in the casing (2) from flowing into the suction passage (20*d*) (see FIGS. 3 and 5).

In accordance with an aspect of the present invention, (i) the displacement pump (20) is linked to a drive shaft (10) of the drive mechanism (4), (ii) the drive shaft (10) is rotatably supported by a bearing member (20*e*) arranged above the displacement pump (20), and (iii) a lubricant-inflow prevention member (29) is provided, the lubricant-inflow prevention member (29) being integral with the bearing member (20*e*) and being formed by a flange (20*e*D) which laterally extends so as to canopy the suction end of the suction passage (20*d*) of the displacement pump (20) (see FIGS. 3 and 5).

In accordance with an aspect of the present invention, (i) a compression gas is directed in such a way as to circle round in the casing (2), (ii) the displacement pump (20) is linked to the drive shaft (10) of the drive mechanism (4), (iii) the drive shaft (10) is rotatably supported by the bearing member (20*e*), (iv) plural fixed legs (20*e*B) are formed on the bearing member (20*e*) projecting therefrom for connection to an interior surface of the casing (2), and (v) the suction end of the suction passage (20*d*) of the displacement pump (20) is located in the vicinity of the fixed leg (20*e*B) and is provided on the downstream side of the compression gas circular flow in relation to the fixed leg (20*e*B) (see FIGS. 3 and 4).

In accordance with an aspect of the present invention, (i) a suction pipe (5) for suction of a compression gas is linked to the casing (2), and (ii) the suction end of the suction passage (20*d*) of the displacement pump (20) is disposed in such a way as to face to an open end of the suction pipe (5) across the center of the drive shaft (10) of the drive mechanism (4) (see FIG. 4).

In accordance with an aspect of the present invention, (i) a compression gas is directed to circle round in the casing (2), (ii) the drive mechanism (4) is disposed above the displacement pump (20), and a vertical lubricant-recovery passage (31) for bringing a lubricant (L) from the compression mechanism (3) back to the lubricant reservoir (2*c*), and (iii) the suction end of the suction passage (20*d*) of the displacement pump (20) is located opposite to a lower end of the lubricant-recovery passage (31) (see FIG. 4).

In accordance with an aspect of the present invention, the lubricant-recovery prevention mechanism (28) includes:

- a lubricant-recovery section (21) for temporarily holding a lubricant (L) on the way from the compression mechanism (3) to the lubricant reservoir (2*c*);
- a lubricant takeout pipe (22) with an inlet end linked to the lubricant-recovery section (21) and an outlet end extending to outside the casing (2);
- an open/close valve capable of switching which is included in the lubricant takeout pipe (22); and
- a release means (23) for releasing the open/close valve (22*a*) when the level of the lubricant (L) stored in the lubricant reservoir (2*c*) goes beyond the predetermined high-limit point (see FIG. 7).

In accordance with an aspect of the present invention, the claim 2 invention, the claim 3 invention, and the claim 13 invention, (i) the drive mechanism (4) includes a motor (9) and a drive shaft (10) which extends through the motor (9) and which has an upper end extending towards the compression mechanism (3) and a lower end soaking in the lubricant (L) stored in the lubricant reservoir (2*c*), and (ii) an oil-level detection means (25) is provided which is capable of detecting an increase in the level of the lubricant (L) stored in the lubricant reservoir (2*c*) when the motor (9) receives a current whose value is above a predetermined input current value.

In accordance with the invention, when the drive mechanism (4) is driven, the compression mechanism (3) compresses a compression gas while at the same time being lubricated by the lubricant (L). During the drive operation, if the oil level goes beyond the predetermined high-limit point, it is forced downward by means of the oil-level lowering means (26). This prevents the oil level from becoming too high, prevents the lubricant (L) from becoming resistant to the drive mechanism (4), and prevents the drive mechanism (4) from stirring the lubricant (L) to give rise to an increase in the oil temperature.

For example, oil-level rising occurring in a refrigerator is a transition phenomenon due to refrigerant contamination. An excess lubricant (L) is temporarily discharged into a refrigerant circulation circuit until the running conditions become stable, to control the oil level to fall within a predetermined range.

In accordance with the invention, when the level of the lubricant (L) stored in the lubricant reservoir (2*c*) goes beyond the high-limit point, the discharge mechanism (27) discharges a lubricant (L) from the lubricant reservoir (2*c*) to lower the oil level. As a result of such arrangement, the oil level is controlled to fall within a predetermined range.

In accordance with the invention, when the level of the lubricant (L) stored in the lubricant reservoir (2*c*) goes beyond the high-limit point, the lubricant-recovery mechanism (28) prevents a lubricant (L) applied to the compression mechanism (3) from returning to the lubricant reservoir (2*c*). As a result of such arrangement, the oil level decreases by a proportional amount to such an obstructed lubricant, and the oil level is controlled to fall within a predetermined range.

In accordance with the invention, during the drive operation, the suction section (14) of the compression mechanism (3) is lower in pressure than the lubricant reservoir (2*c*). When the level of the lubricant (L) stored in the lubricant reservoir (2*c*) goes beyond the high-limit point, an excess lubricant oil flows into the lubricant takeout pipe

(15) because of the difference in pressure between the suction section (14) and the lubricant reservoir (2c), thereafter that excess lubricant oil being fed to the suction section (14) of the compression mechanism (3). As a result, the oil level is lowered, and the oil level can be controlled to fall within the predetermined range.

In accordance with the invention, during the drive operation a compression gas is introduced from the suction pipe (5) to the casing (2). At this point in time, the low-pressure creating section (5a) of the suction pipe (5) is lower in pressure than the lubricant reservoir (2c). When the level of the lubricant (L) stored in the lubricant reservoir (2c) goes beyond the high-limit point, an excess lubricant oil flows into the lubricant takeout pipe (15) because of the difference in pressure between the suction section (14) and the lubricant reservoir (2c), thereafter that excess lubricant oil being fed to the suction section (14) of the compression mechanism (3). As a result, the oil level is lowered, and the oil level can be controlled to fall within the predetermined range.

In accordance with the invention, when the drive mechanism (4) drives the displacement pump (20) and when the level of the lubricant (L) stored in the lubricant reservoir (2c) goes beyond the high-limit point, an excess lubricant oil flows into the displacement pump (20) through the suction passage (20d), thereafter being supplied to the suction section (14) of the compression mechanism (3). As a result, the oil level is lowered, and the oil level can be controlled to fall within the predetermined range.

In accordance with the invention, a lubricant that exists in a space other than the lubricant reservoir (2c) is not allowed to flow into the lubricant takeout pipe (15) because of the provision of the lubricant-inflow prevention member (29). This ensures that a sufficient amount of lubricant is brought back to the lubricant reservoir (2c). As a result, the compression mechanism (3) is lubricated smoothly.

In accordance with the invention, a lubricant that exists in a space other than the lubricant reservoir (2c) is not allowed to flow into the section passage (20d) of the displacement pump (20) because of the provision of the lubricant-inflow prevention member (29). This ensures that a sufficient amount of lubricant is brought back to the lubricant reservoir (2c). As a result, the compression mechanism (3) is lubricated smoothly.

In accordance with the invention, a falling lubricant toward the lubricant reservoir (2c) in the casing (2) is not allowed to enter the suction passage (20d) because of the provision of the flange (20eD) that extends over the suction passage (20d). This prevents the displacement pump (20) from discharging too much lubricant.

In accordance with the invention, on the downstream side of a compression gas circular flow, little or no lubricant oil circles with the compression gas. This prevents a lubricant oil from flowing in the suction passage (20d), thereby preventing the displacement pump (20) from discharging too much lubricant.

In accordance with the invention, the suction pipe (5) and the inlet end of the suction passage (20d) are spaced apart. This prevents a lubricant, introduced from the suction pipe (5) into the casing (2) along with a compression gas, from entering the inlet end of the suction passage (20d).

In accordance with the invention, a lubricant, which enters the compression mechanism (3), passes through the lubricant-recovery passage (31), and falls towards the lubricant reservoir (2c), flows with a compression gas circular flow in the casing (2). This prevents a lubricant from entering the inlet end of the suction passage (20d) disposed below the lubricant-recovery passage (31).

In accordance with the invention, during the drive operation, a lubricant that has been used to lubricate the compression mechanism (3) is stored temporarily in the lubricant-recovery section (21). When the level of the lubricant (L) stored in the lubricant reservoir (2c) stays below the high-limit point, the open/close valve (22a) closes. As a result, the lubricant stored in the lubricant-recovery section (21) is brought back to the lubricant reservoir (2c). On the other hand, when the oil level goes beyond the high-limit point, the release means (23) opens the open/close valve (22a). As a result, the stored lubricant is discharged to outside the casing (2) by means of the lubricant takeout pipe (22). Accordingly the oil level is lowered, and the oil level can be controlled to fall within the predetermined range.

In accordance with the invention, if the oil level goes beyond the high-limit point, this causes the value of an input current to the motor (9) to go beyond the predetermined value. From such an increase in the input current value, the oil-level detection means (25) detects an increase in the oil level. More specifically, the oil-level detection means (25) indirectly detects an oil level by making use of the following. As the oil level goes upward, the crankshaft (10) is soaked more in the lubricant (L) therefore receiving greater rotation resistance. As a result, the motor (9) requires a greater input current. From such an input current increase, the oil-level detection means (25) learns that there is an increase in the oil level.

Accordingly advantages of the present invention are as follows.

According to the invention, the oil-level lowering means (26) is provided which, when the level of the lubricant (L) stored in the lubricant reservoir (2c) goes beyond a predetermined high-limit point, lowers such an increased oil level. As a result of this arrangement, the level of the lubricant (L) can be kept at a desired point with one compressor. The invention prevents the oil level from becoming too high, prevents the lubricant (L) from becoming resistant to the drive mechanism (4), and prevents the drive mechanism (4) from stirring the lubricant (L) to give rise to an increase in the oil temperature. As a result, the occurrence of input loss and the drop in compression efficiency can be controlled.

According to the invention, the discharge mechanism (27) is provided which discharges an excess lubricant from the lubricant reservoir (2c). According to the invention, the lubricant-recovery prevention mechanism (28) is provided which prevents a lubricant on the way from the compression mechanism (3) towards the lubricant reservoir (2c), from being brought back to the lubricant reservoir (2c). The level of the lubricant (L) can be kept at a desired point with one compressor.

According to the invention, the inlet end of the lubricant takeout pipe (15) in communication with the suction section (14) of the compression mechanism (3) opens in such a way as to face to the high-limit point. According to the invention, the inlet end of the lubricant takeout pipe (15) in communication with the suction pipe (5) opens in such a way as to face to the high-limit point. This provides an uncomplicated structure to the discharge mechanism (27) and the provision of the discharge mechanism (27) becomes easy.

In accordance with the invention, the inlet end of the displacement pump (20) connected to the lubricant takeout pipe (15) opens in such a way as to face to the high-limit point. This ensures that the oil level is lowered thereby accomplishing reliable oil-level control.

In accordance with the invention, the lubricant-inflow prevention member (29) is provided which prevents a lubricant present in the casing's (2) internal space from being discharged by the discharge mechanism (27). This assures that a sufficient amount of lubricant is brought back to the lubricant reservoir (2c), therefore preventing the compression mechanism of being short of lubricant. Accordingly highly reliable oil-level control can be accomplished.

In accordance with the invention, the flange (20eD) is formed above the inlet end of the displacement pump (20). The inlet end of the displacement pump (20) is located on the downstream side of a compression gas circular flow in relation to the fixed leg (20eB) of the bearing member (20e). The inlet end of the displacement pump (20) and the suction pipe (5) are spaced apart., the inlet end of the displacement pump (20) is located below the lubricant-recovery passage (31). As a result, with a simple organization, discharge of a lubricant present in the casing's (20) internal space by the discharge mechanism (27) can be prevented. Accordingly highly reliable oil-level control can be accomplished.

In accordance with the invention, when the oil level goes beyond the high-limit point, the open/close valve (22a) of the lubricant takeout pipe (15) opens, whereupon a lubricant to be brought back to the lubricant reservoir (2c) is discharged to outside the casing (2). The lubricant-recovery prevention mechanism (28) can be organized with a simple structure, assuring that the oil level is lowered and accomplishing highly reliable oil-level control.

In accordance with the invention, the oil-level detection means (25) is provided. The lower end of the crankshaft (10) of the compression mechanism (3) lies in the lubricant (L), and when the motor (9) is applied an exess input current above a predetermined current value the oil-level detection means (25) detects an increase in the oil level. Accordingly the oil level can be detected indirectly. More specifically, the oil-level detection means (25) indirectly detects an oil level by making use of the following. As the oil level goes upward, the crankshaft (10) is soaked more in the lubricant (L) therefore receiving greater rotation resistance. As a result, the motor (9) requires a greater input current. From such an input current increase, the oil-level detection means (25) learns that there is an increase in the oil level. Without providing a special oil-level detection means, the oil level can be detected. The oil level can be controlled adequately with a simple structure.

DESCRIPTION OF THE PREFERRED EMBODIMENTS

Preferred embodiments of the present invention are now described below by making reference to the attached drawing figures.

EMBODIMENT 1

Figure 1:
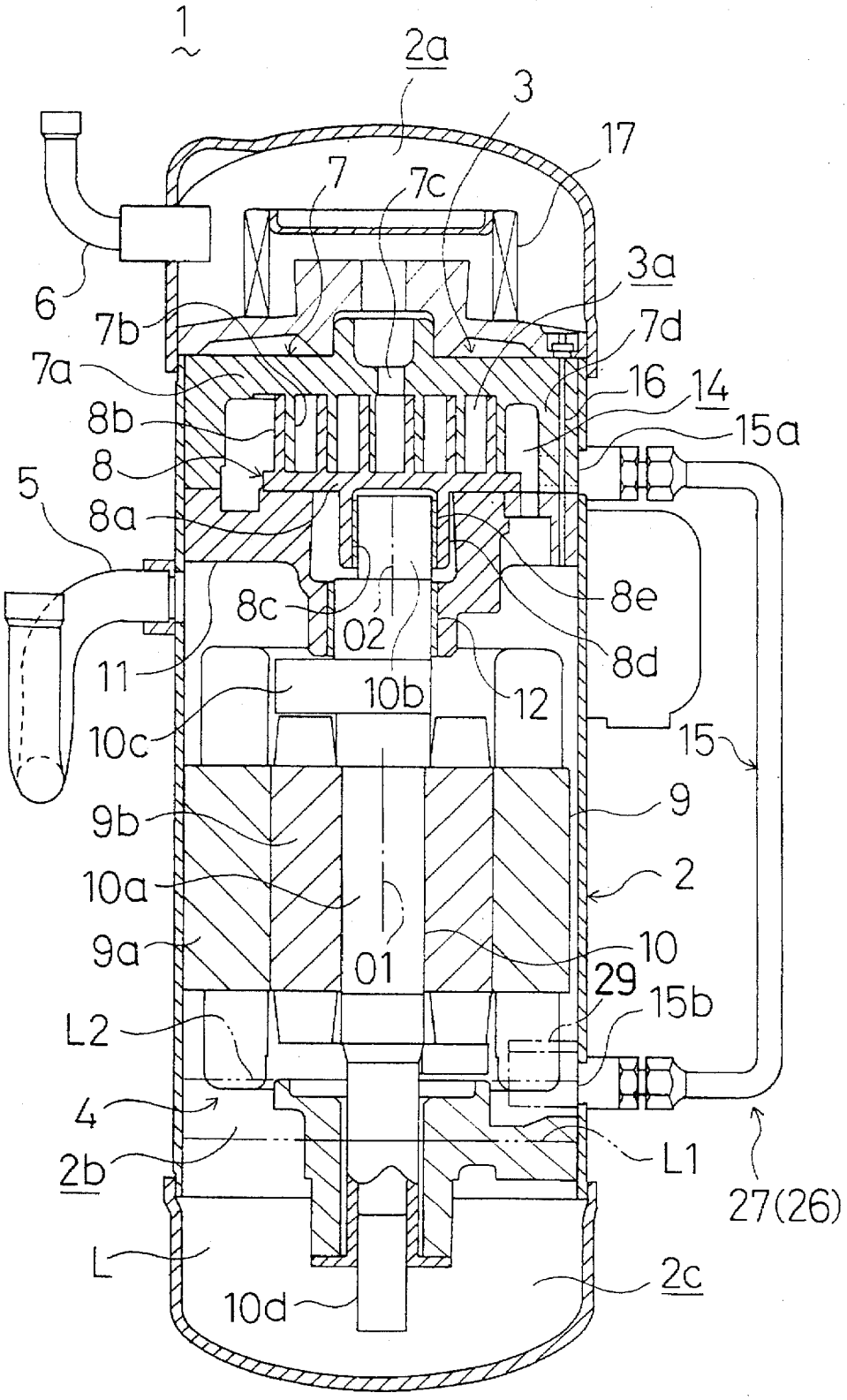
FIG. 1 is a sectional view of a first scroll-type compressor of the present invention.

FIG. 1 shows a compressor (1) of a scroll type employing an oil-level controller in accordance with the present invention. The compressor (1) is included in a refrigerant circulation circuit of a refrigerator, to high-pressure compress a refrigerant gas (i.e., a compression gas).

The scroll-type compressor (1) is housed in an enclosed casing (2). The casing (2) accommodates a scroll mechanism (3) and a drive mechanism (4). A suction pipe (5) is connected to a sidewall central portion of the casing (2) and a discharge pipe (6) is connected to a sidewall upper portion thereof.

The scroll mechanism (3) has a fixed scroll (7) and a revolution scroll (8) to form a compression mechanism. The drive mechanism (4) has a motor (9) and a crankshaft (10). The motor (9) is made up of a stator (9a) fixed to an interior surface portion of the casing (2) and a rotor (9b) rotatably disposed in the stator (9a). The crankshaft (10) runs through the center of the rotor (9b) to form a drive shaft extending towards the scroll mechanism (3).

Whereas the fixed scroll (7) is formed by forming in front of an end plate (7a) a wrap (7b) in an involute fashion, the revolution scroll (8) is formed by forming in front of an end plate (8a) a wrap (8b) in an involute fashion. With the front of the end plate (7a) of the fixed scroll (7) and the front of the end plate (8b) of the revolution scroll (8) facing each other, the fixed scroll (7) and the revolution scroll (8) are disposed in vertical, parallel relationship. The wrap (7b) and the wrap (8b) are engaged with each other. A side of the wrap (7b) is in contact with a side of the wrap (8b) at plural points. Formed between such contact sections is a compression chamber (3a).

Formed at the center of the end plate (7a) of the fixed scroll (7) is a refrigerant outlet end (7c) in communication with the compression chamber (3a) as well as in communication with an upper space (2a) of the casing (2). The fixed scroll (7) has a mount portion (7d) dependent from a peripheral edge of the end plate (7a). The fixed scroll (7) is fixed, at the mount portion (7d), to an interior surface portion of the casing (2). Mounted at the rear of the end plate (8a) of the revolution scroll (8) is a scroll shaft (8d) with a bearing hole (8c) at the center thereof.

A stationary frame (11), which is located on the rear side of the revolution scroll (8), is fixedly displaced in the center of the casing (2). The crankshaft (10) vertically penetrates the frame (11) through a bearing (12). The crankshaft (10) has a crank main shaft (10a) attached to the rotor (9b) of the motor (9) and a coupling pin (10b) off-centered from the axis (01) of the crankshaft (10). The coupling pin (10b) is inserted, through a bearing (8e), into the bearing hole (8c) of the scroll shaft (8d). Therefore the scroll shaft (8d) (the axis (02)) and the crankshaft (10) are not co-axial.

A peripheral portion of the frame (11) is fixed to an interior surface portion of the casing (2). A peripheral upside of the frame (11) and an underside of the mount portion (7d) of the fixed scroll (7) are joined together. The end plate (8a) of the revolution scroll (8) is mounted on an upside of the frame (11) and the revolution scroll (8) is supported by the frame (11).

Mounted between the frame (11) and the end plate (8a) of the revolution scroll (8) is an Oldham's mechanism, not shown in the figure, whereby the revolution scroll (8) moves in a circular orbit without rotating, with respect to the fixed scroll (7).

A suction chamber (14) is defined between the wraps (7b, 8b) and the mount portion (7d) of the fixed scroll (7). Located below the frame (11) is a balancer (10c) of the crankshaft (10).

A lubricant reservoir (2c) for storing a lubricant (L) is formed at the bottom of a lower space (2b) of the casing (2).

An oil feed passage (not shown) is formed extending through the crankshaft (10). This oil feed passage extends from the lower end of the crankshaft (10) to the upper end of the coupling pin (10*a*). The lower end of the crankshaft (10) is soaked in the lubricant (L) stored in the reservoir (2*c*).

A centrifugal pump (10*d*) is mounted at the lower end of the crankshaft (10). As the crankshaft (10) rotates, the centrifugal pump (10*d*) operates, and the lubricant (L) is supplied via the oil feed passage to the bearings (8*e*, 12) and to the scroll mechanism (3).

An advantage of the first embodiment is a lubricant takeout pipe (15) that is connected to an exterior sidewall portion of the casing (2).

The lubricant takeout pipe (15) extends vertically. The lubricant takeout pipe (15) has an outlet end (15*a*) (i.e., the upper end) and an inlet end (15*b*) (the lower end). The outlet end (15*a*), on the one hand, is in communication with the suction chamber (14) via the casing (2) and the mount portion (7*d*) of the fixed scroll (7). The inlet end (15*b*), on the other hand, is in communication with the lower space (2*b*) of the casing (2) via a portion of the casing (2) under the motor (9).

The position of the inlet end (15*b*) of the lubricant takeout pipe (15) is described in detail. The inlet end (15*b*) is located slightly below the rotor (9*b*) of the motor (9). In other words, when the level of the lubricant (L) stored in the lubricant reservoir (2*c*) goes up to a point close to the lower end of the rotor (9*b*) indicated by imaginary line L2 of FIG. 1 (hereinafter called the high-limit point), the inlet end (15*b*) of the lubricant takeout pipe (15) becomes flush with the level of the lubricant (L). An oil-level lowering means (26) acting as a discharge mechanism (27) of the present invention is implemented by the lubricant takeout pipe (15).

As shown in FIG. 1, a lubricant-recovery passage (16) for bringing a lubricant reaching the upper space (2*a*) of the casing (2) back to the lubricant reservoir (2*c*) is formed so as to pass through the mount portion (7*d*) of the fixed scroll (7) and a peripheral portion of the frame (11).

The upper space (2*a*) of the casing (2) is provided with a demister (17) for collecting a lubricant (L) flowing in the lubricant-recovery passage (16).

The operation of the scroll-type compressor (1) is explained.

When the motor (9) is activated to rotate the crankshaft (10), the revolution scroll (8) moves in a circular orbit without rotating, with respect to the fixed scroll (7).

A refrigerant is first introduced through the suction pipe (5) into the casing (2). The refrigerant then passes through the suction chamber (14) to reach the compression chamber (3*a*) of both the scrolls (7, 8) where the refrigerant is compressed. The refrigerant is discharged from a refrigerant outlet end (7*c*) of the fixed scroll (7) to, via the upper space (2*a*) of the casing (2), the discharge pipe (6) out of which the refrigerant is discharged to a refrigerant circulation circuit. During the compression operation a lubricant (L) is supplied to each bearing (12, 8*e*) and to the scroll mechanism (3), via the foregoing oil feed passage of the crankshaft (10).

The advantage of the present embodiment is demonstrated when the level of the lubricant (L) stored in the lubricant reservoir (2*c*) goes up. This is explained below.

Under the normal running conditions the level of the lubricant (L) stored in the lubricant reservoir (2*c*) is in line with imaginary line L1 of FIG. 1.

However, when the compressor (1) has been put out of service for a long time, a liquid refrigerant is likely to "fall asleep". Additionally, when the compressor (1) is run under humid atmosphere conditions, a liquid refrigerant returns to the compressor (1) to be mixed with the lubricant (L) stored in the lubricant reservoir (2*c*). As a result, the level of the lubricant (L) moves up to near the lower end of the rotor (9*b*) of the motor (9). If the oil level goes beyond the high-limit point indicated by imaginary line L2 of FIG. 1, then the inlet end (15*b*) of the lubricant takeout pipe (15) becomes ready for accepting any excess lubricant.

The suction chamber (14) in communication with the outlet end (15*a*) of the lubricant takeout pipe (15) is in a high negative pressure atmosphere resulting from revolution movement by the revolution scroll (8). The suction chamber (14) is in a low pressure state in comparison with the lower space (2*b*) of the casing (2) in communication with the inlet end (15*b*) of the lubricant takeout pipe (15).

Because of such a difference in pressure between the chamber (14) and the space (2*b*), part of the lubricant (L) (i.e., a surface lubricant) flows into the lubricant takeout pipe (15) and climbs up therethrough. The lubricant (L) is supplied from the lubricant takeout pipe (15) to the suction chamber (14). With the compression operation of the refrigerant, the lubricant (L) is discharged, along with a high-pressure refrigerant, from the compression chamber (3*a*) to the discharge pipe (6), via the refrigerant outlet end (7*c*) and the upper space (2*a*).

To sum up, of the lubricant (L) stored in the lubricant reservoir (2*c*) any excess lubricant automatically flows into the inlet end (15*b*) of the lubricant takeout pipe (15) and is discharged into a refrigerant circulation circuit of the refrigerator. The level of the lubricant (L) of the lubricant reservoir (2*c*) is lowered accordingly.

The repetition of such operations prevents the level of the lubricant (L) stored in the lubricant reservoir (2*c*) from going beyond the inlet end (15*b*) of the lubricant takeout pipe (15*a*). Accordingly the level of the lubricant (L) is kept at a desired point.

Particularly for the case of refrigerators, an increase in the oil level is just a transition phenomenon created by, for example, refrigerant contamination. Therefore the oil level can be controlled to fall within a predetermined range by temporarily discharging any excess lubricant to a refrigerant circulation circuit until the refrigerator goes in the stable running conditions.

Since the lubricant level will not go beyond a predetermined point, this prevents the area of the crankshaft (10) that is soaked in the lubricant (L) from increasing and the rotor (9*b*) is not soaked in the lubricant (L). As a result of this, the lubricant (L) is no longer a cause of producing resistance against the rotation of the crankshaft (10) and the rotor (9*b*), and extra input to keep the rotation of the crankshaft (10) constant becomes unnecessary.

Neither the crankshaft (10) nor the rotor (9*b*) stirs the lubricant (L). The increase in the oil temperature can be suppressed, so that the increase in the temperature in the entire interior space of the casing (2) can be suppressed. Therefore the drop in the compression efficiency becomes avoidable.

EMBODIMENT 2

Figure 2:
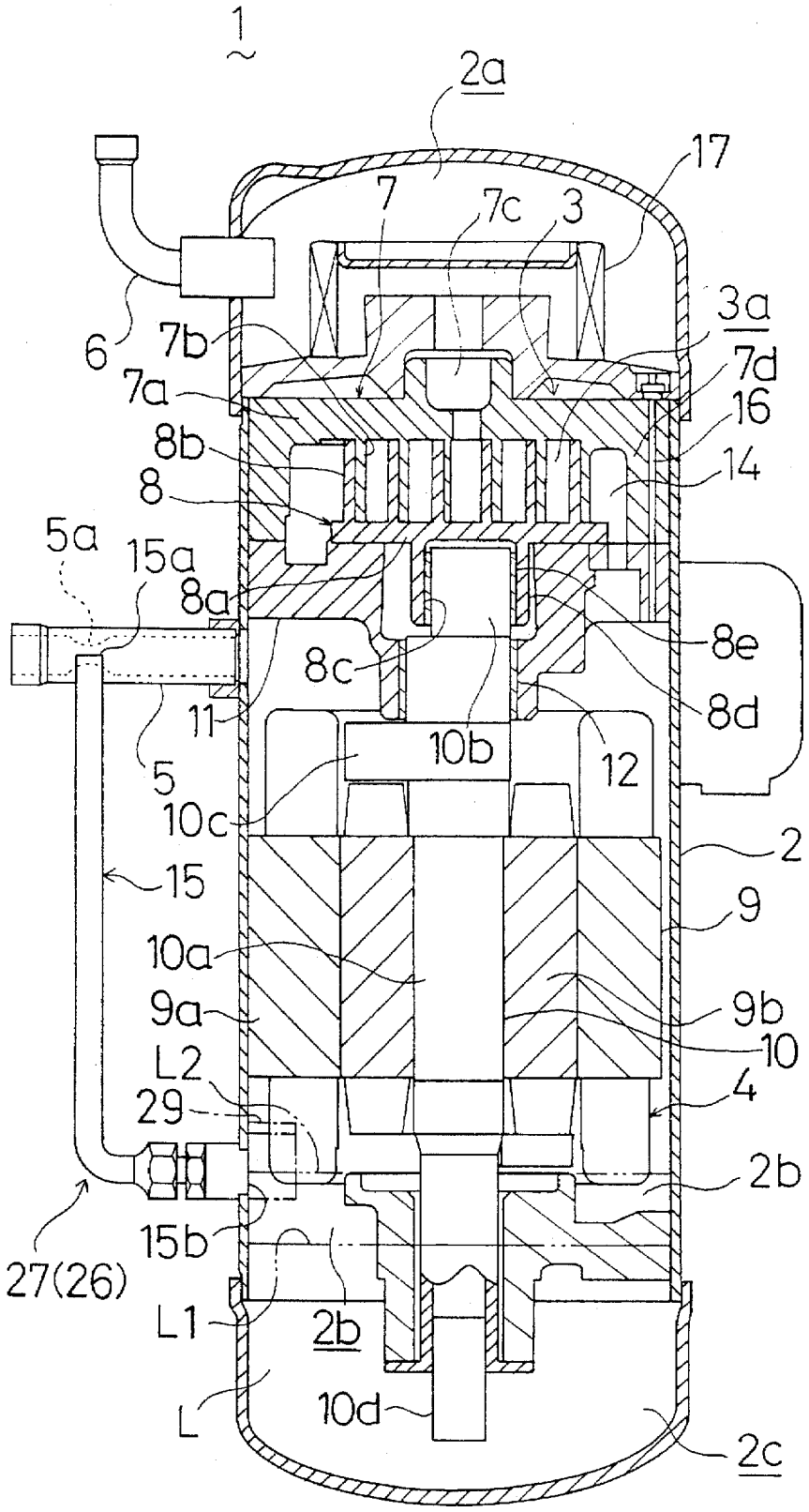
FIG. 2 is a sectional view of a second scroll-type compressor of the present invention.

Referring now to FIG. 2, therein is explained a second preferred embodiment of the present invention.

The second embodiment differs from the first embodiment in that a different layout arrangement of the lubricant takeout pipe (15) is used. With the exception of such a layout arrangement, the second embodiment is identical in organization with the first embodiment. Accordingly the description will be made only on such a layout arrangement of the lubricant takeout pipe (15).

As illustrated in FIG. 2, the outlet end (15*a*) of the lubricant takeout pipe (15) in the scroll-type compressor (1) in accordance with the second embodiment, is connected to the suction pipe (5). The suction pipe (5) has, at its connection with the lubricant takeout pipe (15), a choked section (5*a*) with a smaller inner diameter acting as a low-pressure creation section. Because of the provision of the choked section (5*a*), the velocity of a sucked refrigerant is increased thereby creating a low-pressure section.

As in the first embodiment, the inlet end (15*b*) of the lubricant takeout pipe (15) is, at a position slightly below the rotor (9*b*) of the motor (9), connected to the lower space (2*b*) of the casing (2). In this way, the oil-level lowering means (26) acting as a discharging mechanism (27) of the present invention is implemented by the lubricant takeout pipe (15) of the second embodiment.

How in the second embodiment the lubricant (L) is discharged is explained.

If the level of the lubricant (L) (line L1 of FIG. 2), moves up to a point near the rotor (9*b*) of the motor (9) and if the oil level goes beyond the high-limit point (line L2), then the lubricant (L) faces to the inlet end (15*b*) of the lubricant takeout pipe (15).

The pressure of the choked section (5*a*) of the suction pipe (5) decreases as the velocity of the refrigerant increases. Accordingly the choked section (5*a*) goes into a lower pressure state in comparison with the lower space (2*b*) of the casing (2) in communication with the inlet end (15*b*) of the lubricant takeout pipe (15). Due to such a difference in pressure between the choked section (5*a*) and the lower space (2*b*), which is to say, due to the so-called injector effect, part of the lubricant (L) of the lubricant reservoir (2*c*) begins flowing into the lubricant takeout pipe (15). Then the lubricant (L) climbs up the lubricant takeout pipe (15) and is supplied in the form of a fine spray to the suction pipe (5) from the outlet end (15*a*).

Thereafter, this lubricant (L) together with a refrigerant is introduced into the casing (2), and part of which, with the compression operation of the refrigerant, is discharged to the discharge pipe (6) together with a high-pressure refrigerant, via the suction chamber (14), the compression chamber (3*a*), the refrigerant outlet end (7*c*), and the upper space 2*a*).

Because of the repetition of such operations the present invention prevents input loss due to an excess oil-level and the drop in compression efficiency due to an oil temperature increase.

EMBODIMENT 3

Figure 3:
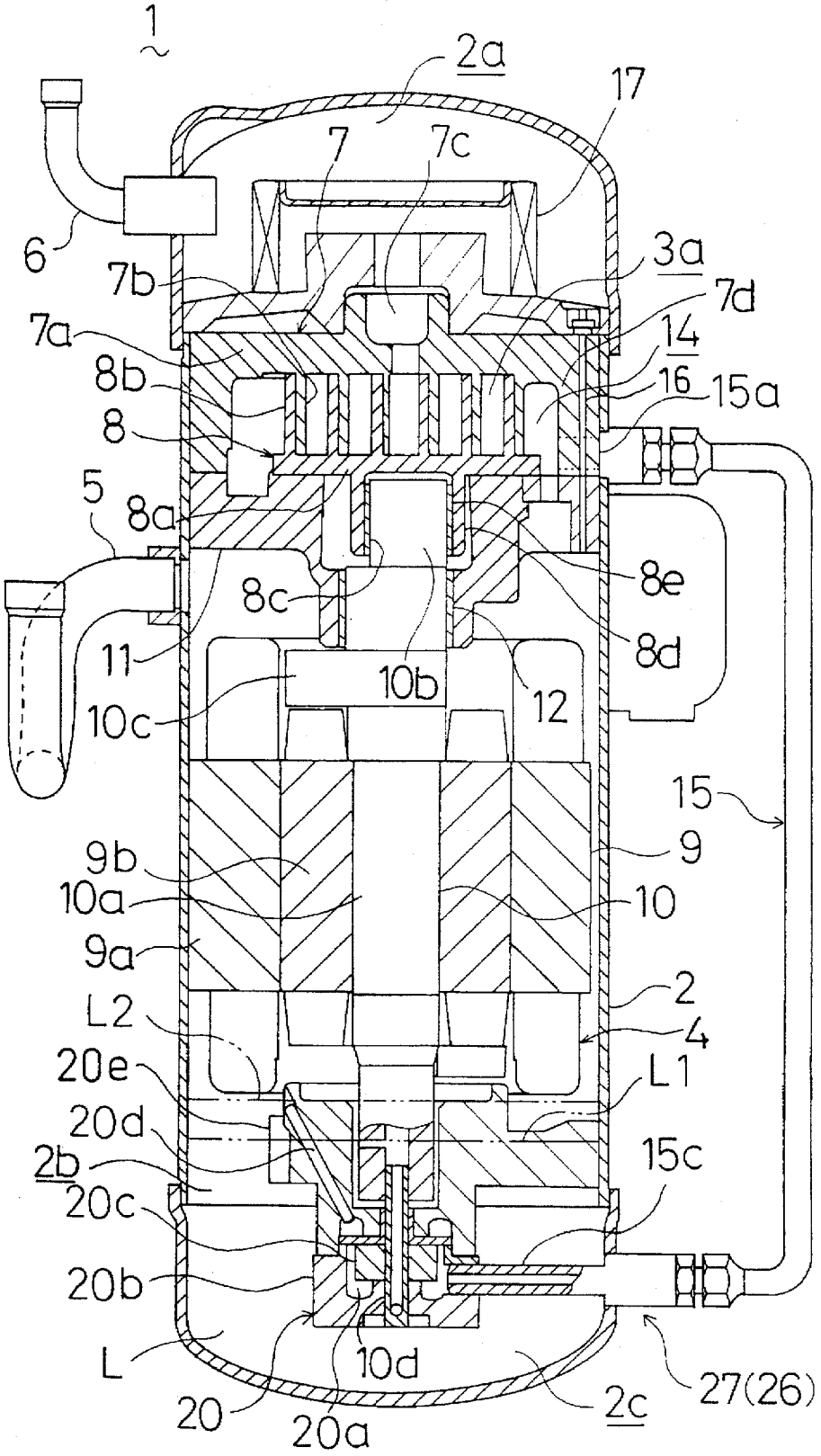
FIG. 3 is a sectional view of a third scroll-type compressor of the present invention.

A third preferred embodiment of the present invention is now explained by making reference to FIG. 3.

In the third embodiment, the lower end of the crankshaft (10) and its peripheral portions are modified. With the exception of such modification, the third embodiment is identical in organization with the first embodiment. Therefore only the modifications made will be described here.

Referring now to FIG. 3, therein is illustrated the scroll-type compressor (1) of the third embodiment. Provided at the lower end of the crankshaft (10) is a trochoid pump (20) (i.e., a displacement pump). The trochoid pump (20) includes a pump casing (20*b*) in which a pump chamber (20*a*) is formed and an impeller (20*c*) which is housed in the pump casing (20*b*) and which rotates with the crankshaft (10). The trochoid pump (20) performs predetermined pump operations as the impeller (20*c*) rotates. Located above the pump casing (20*b*) is a bearing member (20*e*) for supporting the lower end of the crankshaft (10). Defined between the bearing member (20*e*) and the pump casing (20*b*) is the foregoing pump chamber (20*a*).

A suction passage (20*d*) is formed in the trochoid pump (20), penetrating the bearing member (20*e*). As the suction passage (20*d*) goes up, it inclines outwardly. The suction passage (20*d*) opens at one end near the upper-end square section of the bearing (20*e*).

The upper end of the suction passage (20*d*) acting as an inlet end is located below the rotor (9*b*) of the motor (9). When the level of the lubricant (L) of the lubricant reservoir (2*c*) goes up to near the lower end of the rotor (9*b*) (i.e., line L2 of FIG. 3), the lubricant (L) flows into the inlet end of the suction passage (20*d*).

A coupling pipe (15*c*) is connected between the lubricant takeout pipe (15) and the trochoid pump (20). In this way, the oil-level lowering means (26) acting as a discharge mechanism (27) is implemented by the trochoid pump (20) and the lubricant takeout pipe (15).

How in the third embodiment a lubricant is discharged is explained below.

During the drive operation of the compressor (1) the impeller (20*c*) of the trochoid pump (2O) is rotated in the pump chamber (20*a*) by the crankshaft (10), whereupon a fluid, introduced at the inlet end of the suction passage (20*d*), is discharged to the coupling pipe (15*c*).

In such a situation, the level of the lubricant (L) in line with line L1 of FIG. 3 may go up to near the lower end of the rotor (9*b*) of the motor (9) because of liquid refrigerant contamination. If the oil level goes beyond the high-limit point (line L2 of FIG. 3), part of the lubricant (L) flows into the inlet end of the suction passage (20*d*). The lubricant (L) then flows into the lubricant takeout pipe (15) via the pump chamber (20*a*) and the coupling pipe (15*c*).

Thereafter the lubricant (L) climbs up the lubricant takeout pipe (15) and is supplied to the suction chamber (14) from the outlet end (15*a*) of the lubricant takeout pipe (15). Then the lubricant (L), with the compression operation of a refrigerant, is discharged to the discharge pipe (6) together with a high-pressure refrigerant, by way of the refrigerant outlet end (7*c*) and the upper space (2*a*).

Because of the repetition of such operations the present invention prevents input loss due to an excess oil-level and the drop in compression efficiency due to an oil temperature increase.

In accordance with the present embodiment, the oil level is lowered by the discharge operation of the trochoid pump (20), which ensures that the oil-level is lowered adequately. This accomplishes reliable oil-level control.

MODIFICATION OF EMBODIMENT 3

A modification of the third embodiment using the trochoid pump (20) will be described below.

This modification is intended to prevent a falling lubricant (L) towards the lubricant reservoir (2*c*) in the casing (2) or a mist-like lubricant (L) flowing with a refrigerant that circles in the casing (2), from entering the pump chamber (20*a*) of the trochoid pump (20).

The trochoid pump (20) is originally provided to discharge an excess lubricant from the lubricant reservoir (2*c*) of the casing (2). If, however, a lubricant (L) on the way back to the lubricant reservoir (2*c*) or a lubricant (L) flowing in the casing (2) is discharged outside, then the lubricant reservoir (2*c*) will be short of lubricant. As a result, the oil level becomes too low. This may produce the problem that the scroll mechanism (3) is not lubricated smoothly.

To prevent the occurrence of the above-noted problem, the following four structures are proposed with respect to the discharge mechanism (27).

Before starting describing these four structures, how the bearing member (20*e*) in which the suction passage (20*d*) is formed is explained.

Figure 4:
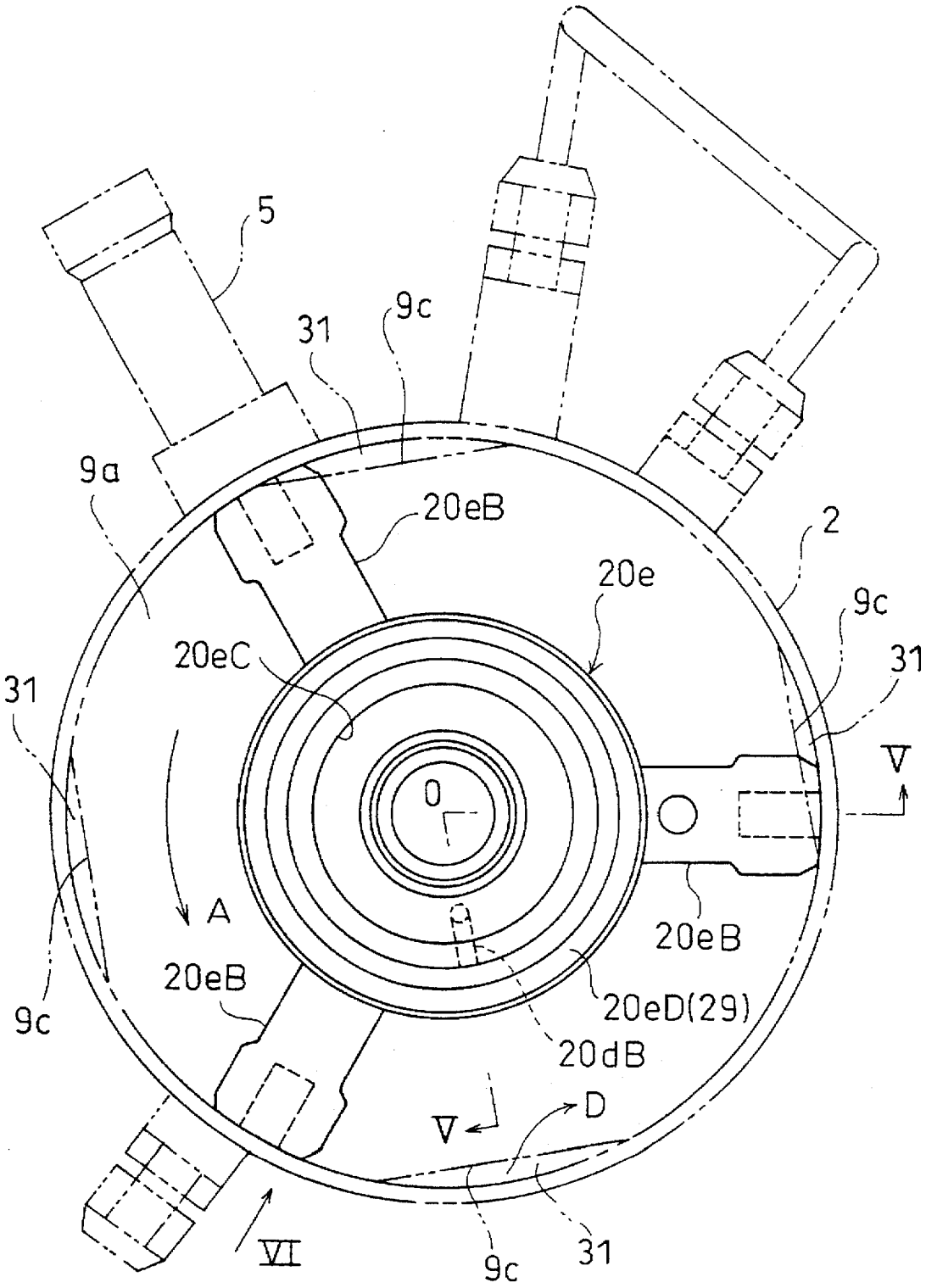
FIG. 4 is a top view of a bearing member and its peripheral portions.
Figure 5:
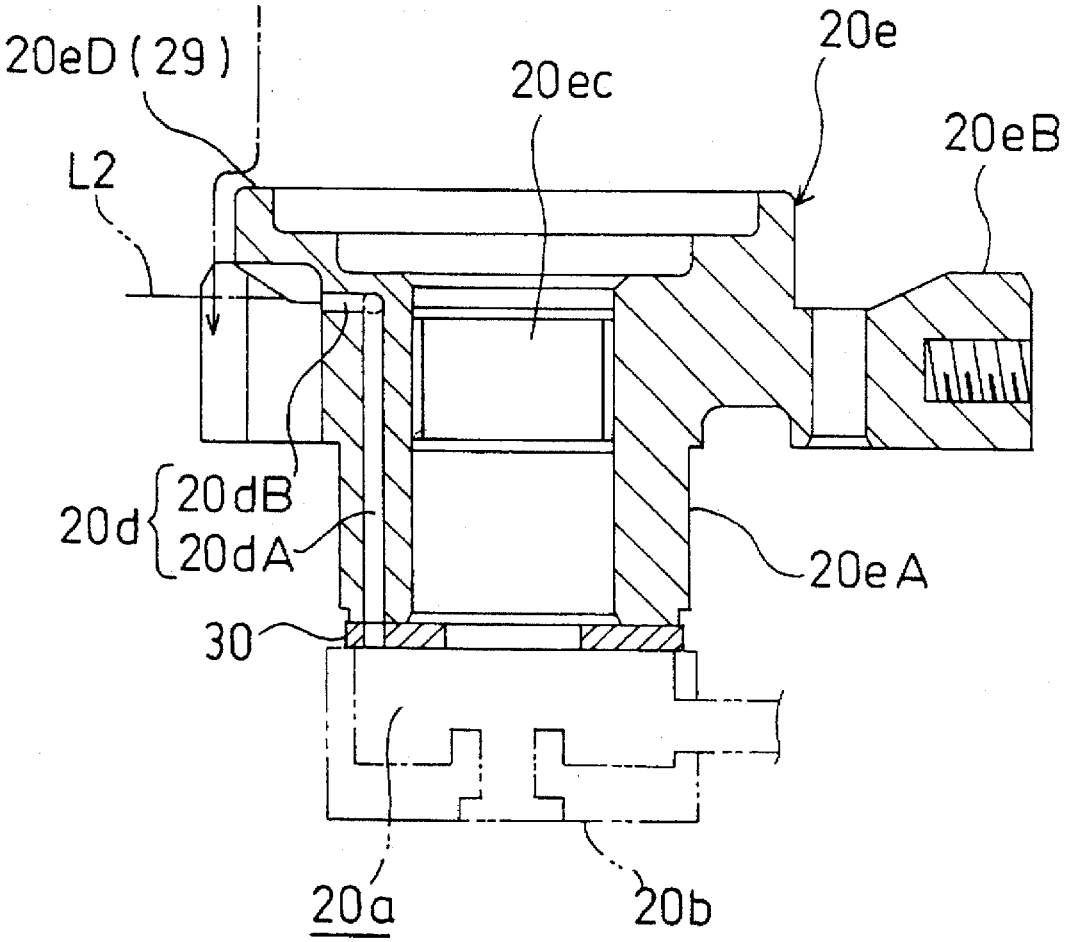
FIG. 5 is a sectional view taken along lines V—V of FIG. 4.

FIG. 4 is a top plan view showing the bearing member (20*e*) and its peripheries. FIG. 5 is a sectional view taken along lines V—V of FIG. 4. As seen from FIGS. 4 and 5, the bearing member (20*e*) has a tubular bearing body (20*e*A) and three fixed legs (20*e*B, 20*e*B, 20*e*B). These three fixed legs (20*e*B, 20*e*B, 20*e*B), spaced at 120 degrees, extend radially from a peripheral surface of the bearing body (20*e*A) and are fixed to interior surface portions of the casing (20). A bearing hole (20*e*C) is formed through the bearing body (20*e*A). The crankshaft (10) is inserted into the bearing hole (20*e*C) extending therethrough. Provided between the underside of the bearing member (20*e*) and the pump casing (20*b*) is a spacer (30). The pump chamber (20) is formed within the pump casing (20*b*).

The foregoing prevention means for preventing the trochoid pump (20) from discharging a falling lubricant (L) or a flowing lubricant in the casing (2) are explained in detail. The scroll-type compressor (1) is designed as follows. A refrigerant, introduced from the suction pipe (5), flows counterclockwise (arrow A) within the casing (2), and the refrigerant is introduced into the suction chamber (14) of the scroll mechanism (3), and a mist-like lubricant (L) flows with the refrigerant that circles in the casing (2).

PREVENTION MEANS 1

A first prevention means is described. As shown in FIG. 5, the first prevention means is formed by a flange (20*e*D) of the bearing member (20*e*). The flange (20*e*D) is a rim extending outwardly from an upper end portion of the bearing member (20*e*). The flange (20*e*D) is formed all around the bearing member (20*e*). In other words, the bearing body (20*e*A) has an upper section with a greater diameter than the remaining other sections thereof.

The suction passage (20*d*) has a vertical section (20*d*A) which vertically extends through the bearing body (20*e*) and whose lower end is connected, via the spacer (30), to the pump chamber (20*a*), and a lateral section (20*d*B) which extends in a lateral, outward direction from the upper end of the vertical section (20*d*A).

The lateral section (20*d*B) has an inlet end located near and below the flange (20*e*D) of the bearing body (20*e*A). In other words, the flange (29*e*D) canopies the inlet end of the lateral section (20*d*B). The flange (20*e*D) constitutes a lubricant-inflow prevention means (29) of the present invention.

The flange (29*e*D) prevents a lubricant (L), which falls towards the lubricant reservoir (2*c*) after lubricating the scroll mechanism (3), from entering the lateral section (20*d*B) of the suction passage (20*d*) (see dot-dash line arrow of FIG. 5). That is, the trochoid pump (20), only when the level of the lubricant (L) stored in the lubricant reservoir (2*c*) of the casing (2) reaches the inlet end of the lateral section (20*d*B) (line L2 of FIG. 5), discharges an excess lubricant. As a result, unnecessary discharge of the lubricant (L) can be prevented.

Second to fourth prevention means are explained. In these prevention means, the suction passage (20*d*) is formed in a different location and the positional relationship of the suction passage (20*d*) with the other members is modified.

PREVENTION MEANS 2

Figure 6:
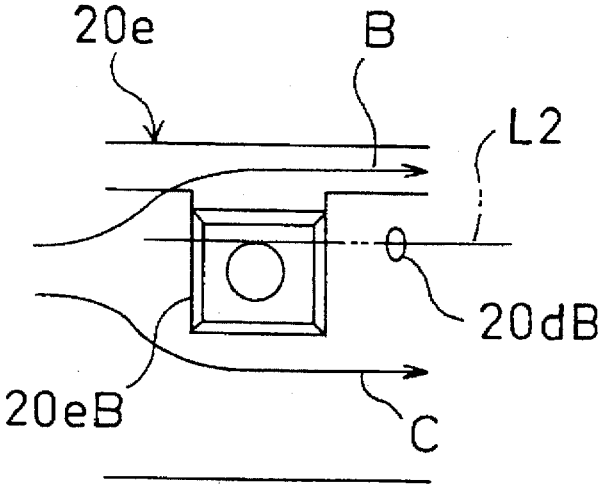
FIG. 6 is an arrow diagram in the direction of arrow VI.

The second prevention means is directed to the inlet end of the suction passage (20*d*). More specifically, as shown in FIGS. 4 and 6, the inlet end of the lateral section (20*d*B) of the suction passage (20*d*) is located next to a counterclockwise sidewall in FIG. 4 in relation to the fixed leg (20*e*B).

Because of the above-described structure, during the drive operation, the circular flow of a refrigerant introduced from the suction pipe (5) into the casing (2) branches out, around the fixed leg (20*e*B), into an upper flow that flows over the fixed leg (20*e*B) (arrow B of FIG. 6) and a lower flow that flows under the fixed leg (20*e*B) (arrow C). As a result, there is little or no flow of the refrigerant around the inlet end of the lateral section (20*d*B) located next to the fixed leg (20*e*B).

Accordingly a mist-like lubricant (L) that flows with a refrigerant is controlled not to enter the suction passage (20*d*). In other words, the fixed leg (20*e*B) constitutes the lubricant-inflow prevention member (29). The trochoid pump (20), only when the level of the lubricant (L) stored in the lubricant reservoir (2*c*) of the casing (2) reaches the inlet end of the lateral section (20*d*B) (line L2 of FIG. 5), discharges an excess lubricant. As a result, unnecessary discharge of the lubricant (L) can be prevented.

PREVENTION MEANS 3

The third prevention means relates to the formation location of the suction passage (20*d*). As shown in FIG. 4, the suction passage (20*d*) is formed such that the suction passage (20*d*) and the suction pipe (5) face each other across the center (0) of the casing (2). In other words, the inlet end of the lateral section (20*d*B) of the suction passage (20*d*) and the suction pipe (5) are spaced apart.

As a result of such an arrangement that the suction pipe (5) is separated from the inlet end of the lateral section (20*d*B), a mist-like lubricant (L), introduced into the casing (2) from the suction pipe (5) together with a refrigerant, is controlled not to enter the lateral section (20*d*B). No lubricant other than the lubricant (L) stored in the lubricant reservoir (2*c*) of the casing (2) is likely to enter the lateral section (20*d*B) of the suction passage (20*d*). Unnecessary discharge of the lubricant (L) can be prevented.

PREVENTION MEANS 4

The fourth prevention means is directed to the formation location of the suction passage (20*d*). As represented by imaginary line of FIG. 4, the stator (9*a*) of the motor (9) disposed above the bearing member (20*e*) has on its peripheral edge four notches (9*c*, 9*c*, 9*c*, 9*c*). Each notch (9*c*) works to bring a lubricant (L), which goes down in the casing (2) after lubricating the scroll mechanism (3), back to the lubricant reservoir (2*c*). The upper and lower spaces of the motor (9) are connected together by the notches (9*c*, 9*c*, 9*c*, 9*c*). In other words, the provision of the notches (9*c*, 9*c*, 9*c*, 9*c*) form lubricant-recovery passages (31, 31, 31, 31).

In accordance with the fourth prevention means, the inlet end of the lateral section (20*d*B) of the suction passage (20*d*) and a lubricant-recovery passage (31) are disposed at circumferentially the same location. In other words, the inlet end of the lateral section (20*d*B) and the lubricant-recovery passage (31) face each other in the radial direction of the casing (2).

During the drive operation, a lubricant (L), which falls towards the lubricant reservoir (2*c*) from the scroll mechanism (3) through the lubricating recovery passage (31) opposite to the inlet end of the lateral section (20*d*B), flows counterclockwise because a refrigerant circles in the casing (2) (arrow D of FIG. 4). As a result, the lubricant (L) is controlled not to flow into the suction passage (20*d*) at the inlet end of the lateral section (20*d*B). The trochoid pump (20), only when the level of the lubricant (L) stored in the lubricant reservoir (2*c*) of the casing (2) reaches the inlet end of the lateral section (20*d*B) (line L2 of FIG. 5), discharges an excess lubricant. As a result, unnecessary discharge of the lubricant (L) can be prevented.

As described above, the first to fourth prevention means each prevent a falling lubricant towards the lubricant reservoir (2*c*) or a flowing lubricant that flows with a refrigerant that circles in the casing (2), from entering the pump chamber (20*a*) of the trochoid pump (20). Accordingly the scroll mechanism (3) can be lubricated smoothly, since it is assured that a sufficient amount of lubricant is brought back to the lubricant reservoir (2*c*) thereby preventing the level of the lubricant (L) from becoming too low.

In comparison with a technique that uses the trochoid pump (20) of FIG. 3 to lower the oil level, each prevention means can provide more effective oil-level lowering operations. More reliable oil-level control is accomplished.

The above-described structure may be applicable to the first and second embodiments making use of the difference in pressure between the chambers. An L-shaped baffle plate (29) as a lubricant-inflow prevention member, indicated by dot-dash line in FIGS. 1 and 2, is attached to an interior surface portion of the casing (2) near the inlet end (15*b*) of the lubricant takeout pipe (15), to prevent a falling lubricant or a flowing lubricant in the casing (2), from being introduced into the lubricant takeout pipe (15). The lubricant takeout pipe (15) may be located at the same position as is located in the first to fourth prevention means for accomplishing reliable oil-level control.

EMBODIMENT 4

Figure 7:
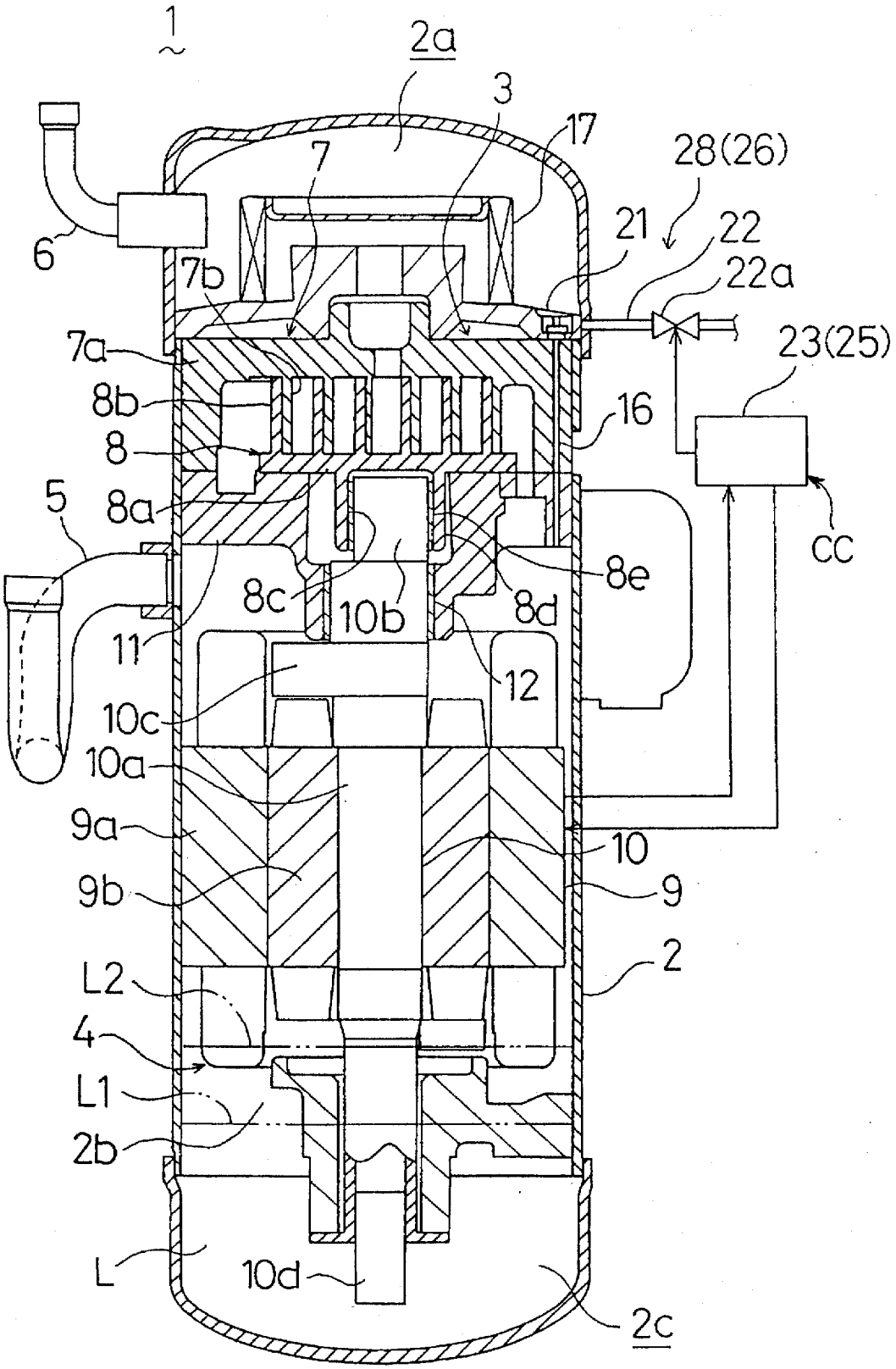
FIG. 7 is a sectional view of a fourth scroll-type compressor of the present invention.

Referring now to FIG. 7, a fourth embodiment of the present invention will be described. Only features of the present embodiment are described here.

The scroll-type compressor (1) of the fourth embodiment is illustrated in FIG. 7. Formed on the upper end of the lubricant-recovery passage (16) is a lubricant-recovery section (21) for holding a lubricant that has reached the upper space (2*a*) of the casing (2) after lubricating the scroll mechanism (3). A lubricant takeout pipe (22) is provided with an inlet end and an outlet end, the inlet end, on the one hand, being in communication with the lubricant-recovery section (21) and the outlet end, on the other hand, being in communication with a refrigerant circulation circuit.

A solenoid valve (22*a*) as an open/close valve is included in the lubricant takeout pipe (22). When the solenoid valve (22*a*) is closed, a lubricant in the lubricant-recovery section (21) flows into the lubricant reservoir (2*c*) through the lubricant-recovery passage (16). When the solenoid valve (22*a*) is opened, a lubricant in the lubricant-recovery section (21) is introduced to the low-pressure side of the refrigerant circulation circuit by way of the lubricant takeout pipe (22). In this way, the oil-level lowering means (26) as a lubricant-recovery prevention mechanism (28) is implemented.

The compressor (1) of the fourth embodiment is inverter-controlled, and the value of input current to the motor (9) is detected. A current value detected is fed to a controller (CC). The controller (CC) feedback-controls input to the motor (9) according to the detected current value.

As one of the features of the present embodiment, the switching operation of the solenoid valve (22*a*) is controlled by the controller (CC) according to the current value detected. More specifically, the controller (CC) has a release means (23) and an oil-level detection means (25). If a current value detected is below a predetermined value, then the release means (23) shuts the solenoid valve (22*a*). On the other hand, if a current value detected is above the predetermined value, then the release means (23) opens the solenoid valve (22*a*). The oil-level detection means (25) detects an increase in the oil level when a detected current value goes beyond the predetermined current value.

How in the present invention a lubricant is discharged is now described.

When the compressor (1) is being driven, the value of an input current applied to the motor (9) is detected, and such a detected current value is fed to the controller (CC). Thereafter the controller (CC) feedback-controls, based on the detected current value, input to the motor (9) while controlling the solenoid valve (22*a*) of the lubricant takeout pipe (22).

When the level of the lubricant (L) is in line with line L1 of FIG. 7 (i.e., the normal state), the area of the crankshaft (10) sunk in the lubricant (L) is negligible. Therefore the crankshaft (10) can rotate with being imposed less resistance, and an input current to the motor (9) has a value as low as a given, rated current value.

In such a situation, the solenoid valve (22*a*) is closed by the controller (CC), whereupon a lubricant in the lubricant-recovery section (21) flows into the lubricant reservoir (2*c*) through the lubricant-recovery passage (16). This prevents the level of the lubricant (L) from going too low, and this assures lubrication stability.

On the other hand, if the lubricant (L) is contaminated with a liquid refrigerant, this causes the oil level (line L1 of FIG. 7) to go up to near the lower end of the rotor (9*b*) of the motor (9). If the oil level further goes beyond the high-limit point (line L2 of FIG. 7), then the area of the crankshaft (10) under the surface of the lubricant (L) increases. As the sunk area of the crankshaft (10) increases, the crankshaft (10) suffers more resistance against its rotation. As a result, the value of input current to the motor (9) increases.

In such a situation, the controller (CC) opens the solenoid valve (22*a*), whereupon a lubricant in the lubricant-recovery section (21) is directed to the circulation circuit through the lubricant takeout pipe (22). This prevents a lubricant in the lubricant-recovery section (21) from being brought back to the lubricant reservoir (2*c*). The loss of input to the compressor (1) caused by an increase in the oil level and the drop in the compression efficiency caused by an increase in the oil temperature can be prevented.

In accordance with the present embodiment, adjustment of the oil level is performed by making effective use of detected current values of input to the motor used for feedback control. This eliminates the need for providing a dedicated oil-level detection means. The oil level is detected indirectly in the present invention, thereby accomplishing reliable oil-level control with a simple structure.

Each embodiment of the present invention has been described in the event of refrigerating compressors. However, the present invention may be practiced in a compressor mounted on a different types of apparatus.

Further, the present invention may be useful for rotary piston-type compressors.

Each embodiment has been described in terms of a refrigerator with a single scroll-type compressor (1). However, the present invention may be applicable in a refrigerator with plural compressors in parallel relationship. In such a case, a plurality of compressors each having lubricant takeout pipes (15, 22) of the present invention are connected together in parallel relationship and oil-level control of each of the compressors can be accomplished.

Accordingly, unlike a forced differential pressure method that produces the problem that the drop in internal pressure with the loss of suction pressure occurs, the present invention provides the advantage that the drop in performance of a compressor provided on the low-pressure side can be prevented. The present invention provides a high-performance refrigerator which has a structure free from the loss of suction pressure and which accomplishes improved oil-level control.

INDUSTRIAL APPLICATION

The present invention finds applications in refrigerating compressors, particularly in a compressor in which the oil level varies due to a liquid stream.

The invention claimed is:

1. A compressor having a function of controlling an oil level, comprising:

a casing (2);

a compression mechanism (3) for compressing a compression gas, which is housed in said casing (2) and includes a low pressure part of which gas pressure is low;

a lubricant reservoir (2*c*) for storing a lubricant (L), which is provided at the bottom of said casing (2), and in which an upper limit of the oil level of the lubricant (L) is predetermined, the lubricant (L) of said lubricant reservoir (2*c*) being supplied to said compression mechanism (3);

a drive mechanism (4) for driving said compression mechanism (3), which is housed in said casing (2) and includes a drive shaft (10);

a lubricant takeout pipe (15) for taking out said lubricant (L), an outlet end of which is connected to the low pressure part of said compression mechanism (3); and pump means provided at said lubricant reservoir (2*c*), a suction end of which is open at the upper limit of the oil level of said lubricant reservoir (2*c*) and a discharge end of which is connected to an inflow end of a lubricant takeout pipe (15), said pump means being driven by means of said drive mechanism;

wherein said pump means (20) discharges said lubricant (L) from said lubricant reservoir (2*c*) to the low pressure part of said compression mechanism (3) when the oil level of said lubricant (L) in said lubricant reservoir (2*c*) goes beyond the predetermined upper limit of the oil level thereof.

2. A compressor as claimed in claim 1, wherein the compression gas in said casing (2) is circulated, said pump means (20) is connected to said drive shaft (10) of said drive mechanism (4), said drive mechanism (4) includes a bearing member (20*e*) for rotatably supporting said drive shaft (10) and a plurality of fixed legs (20*e*B) projecting from said bearing member (20*e*) to be connected to the inside of said casing (2), and the suction end of said pump means (20) is located near the fixed legs (20*e*B) and at a downstream side of the circulation of the compression gas with respect to said fixed legs (20*e*B).

3. A compressor as claimed in claim 1, further comprising a suction pipe (5), connected to said casing (2), for sucking the compression gas, wherein the suction end of said pump means (20) is located opposite to an open end of the suction pipe (5) with respect to said drive shaft (10) of said drive mechanism (4) as a center.

4. A compressor as claimed in claim 1, further comprising a lubricant-recovery passage (31) in a perpendicular direction for bringing said lubricant (L) from said compression mechanism (3) back to said lubricant reservoir (2*c*), wherein the compression gas is circulated in said casing (2), said drive mechanism is arranged above the pump means (20), and the suction end of said pump means (20) is opposed to a lower end part of said lubricant-recovery passage (31).

5. A compressor as claimed in claim 1, wherein said pump means (20) includes a suction passage (20*d*), and said compressor further comprising a lubricant-inflow prevention member (29), provided at the vicinity of the suction end of said suction passage (20*d*) of said pump means (20), for preventing said lubricant (L) within said casing (2) from flowing into said suction passage (20*d*).

6. A compressor as claimed in claim 1, further comprising: a lubricant-inflow prevention member (29), provided at the vicinity of the suction end of said suction passage (20*d*) of said pump means (20), for preventing said lubricant (L) within said casing (2) from flowing into said suction passage (20*d*), wherein said lubricant-inflow prevention member (29) is composed of a flange (20*e*D) integrally formed with said bearing member (20*e*) and extending in a horizontal direction to cover the upper part of the suction end of said suction passage (20*d*) of said pump means (20), said drive mechanism (4) includes a bearing member (20*e*), arranged above said pump means (20), for rotatably supporting said drive shaft (10), and said pump means (20) is connected to said drive shaft (10) of said drive mechanism (4) and includes a suction passage (20*d*).

7. A compressor as claimed in any one of claims 1, 2, 3, 4, 5 or 6, wherein said pump means (20) is a displacement pump (20).

* * * * *